United States Patent [19]

Morton et al.

[11] 4,017,385

[45] Apr. 12, 1977

[54] MAGNETIC SEPARATOR SYSTEMS

[76] Inventors: Peter Harlow Morton, 12 Danford Lane, Solihull, Warwickshire; Enrico Cohen, 66 Wolsey Road, Moor Park, Northwood, Middlesex HA6 2EH; Jeremy Andrew Good, 72 Lexham Gardens, London W8, all of England

[22] Filed: Sept. 6, 1974

[21] Appl. No.: 504,669

[30] Foreign Application Priority Data

Sept. 11, 1973 United Kingdom ..... 42566/73
July 17, 1973 United Kingdom ..... 31657/73

[52] U.S. Cl. ..... 209/214; 209/232; 209/223 R; 209/39

[51] Int. Cl.[2] ..... B03C 1/00

[58] Field of Search ..... 209/223 R, 222, 224, 209/232, 214, 213, 39, 40; 210/222, 223

[56] References Cited

UNITED STATES PATENTS

| | | | |
|---|---|---|---|
| 1,056,318 | 3/1913 | Bruck | 209/232 |
| 1,527,070 | 2/1925 | Peck | 209/220 |
| 2,973,096 | 2/1961 | Greaves | 210/222 X |
| 2,979,202 | 4/1961 | Orbeliani | 210/222 X |
| 3,503,504 | 3/1970 | Bannister | 209/232 X |
| 3,608,718 | 9/1971 | Aubrey | 209/214 |
| 3,693,792 | 9/1972 | Lang | 209/232 X |

FOREIGN PATENTS OR APPLICATIONS

| | | | |
|---|---|---|---|
| 160,503 | 6/1941 | Austria | 209/223 R |
| 275,912 | 10/1968 | U.S.S.R. | 209/39 |

*Primary Examiner*—Robert Halper
*Attorney, Agent, or Firm*—Cushman, Darby & Cushman

[57] ABSTRACT

A method and apparatus for separating magnetically susceptible particles from a mixture of magnetically susceptible particles and non-magnetic or less magnetically susceptible particles in which a stream containing the mixture in a fluidized condition is introduced under pressure or under gravity into one end of an arcuate separation channel having an inlet end and an outlet end and arcuate inner and outer walls and at least one connecting wall which confine the steam and constrain it to flow in a single unidirectional arcuate path along the channel in frictional contact with the inner and outer walls and with the connecting wall, the velocity of the stream and the frictional resistance to flow being such that the stream is subject to sufficient centrifugal force as it flows around the channel that there is produced in the channel a secondary circulation radially outwardly within the body of the stream and then radially inwardly, in which the stream during its passage around the channel is subjected to a radial magnetic field gradient so that the magnetic force and the secondary circulation cooperate to cause the magnetically susceptible particles to gravitate toward the magnet while moving through the channel, and in which the magnetically susceptible particles are removed from that radial side of the arcuate channel which is adjacent the magnet while the non-magnetic or less magnetically susceptible particles are removed from that radial side which is remote from the magnet.

12 Claims, 3 Drawing Figures

MAGNETIC SEPARATOR SYSTEMS

BACKGROUND OF THE INVENTION

This invention relates to magnetic separator systems and methods of use thereof. The invention is particularly concerned with the magnetic separation of magnetically susceptible solid particles from a flowing stream of fluid. The fluid may be liquid or gaseous. The invention is especially concerned with the separation of particles of a relatively higher magnetic susceptibility from particles of a relatively lower or zero magnetic susceptibility in a flowing stream of fluid.

The term "particle" as used above and throughout the remainder of the specification refers, unless the context dictates otherwise, to sizes ranging from the sub-micrometer to several millimeters or more.

It has been proposed to use magnetic separators for the separation of magnetic particles from non-magnetic particles, the magnetic separators utilising superconducting magnets. In British Patent Specification No. 1202100, there is described a magnetic separator in which a superconducting magnet is used to pull magnetically susceptible particles from a small separating zone. The particles are in a fluidised feed and the feed is surrounded by wash fluid, the two streams passing downwardly through the small separating zone under the influence of gravity or by being pumped through the zone. The magnetic particles are only influenced by the magnetic field for a very short period of time in such a separator. This necessarily limits the degree of separation which can occur.

SUMMARY OF THE INVENTION

By the present invention there is provided a magnetic separator system for the separation of magnetically susceptible particles from a mixture of magnetically susceptible particles and non-magnetic or less magnetically susceptible particles, including an inlet for containing a flowing stream of a fluid containing the mixture, the inlet leading to an arcuate channel separation zone from which lead mutually separated first and second outlets, and a magnet located in the vicinity of the separation zone and more closely adjacent the second outlet than the first outlet, the magnet being operable, in use, to provide a magnetic field gradient across the separation zone whereby said particles are attracted into the second outlet.

In one embodiment the arcuate channel may be rectangular in cross-section, and has two sides substantially horizontal, the magnet being disposed around the outside of the channel. In another embodiment the floor of the arcuate channel is inclined downwardly from the inner side to the outer side, having a part-truncated conical shape, and the arcuate channel is disposed around the outside of the magnet. The arcuate channel in this embodiment may be of parallelogram cross-section. The parallelogram may be helically inclined with respect to the centre line of the magnet.

BRIEF DESCRIPTION OF THE DRAWINGS

By way of example, embodiments of the present invention will now be described with reference to the accompanying diagrammatic drawings in which.

DESCRIPTION OF THE PREFERRED EMBODIMENTS

Figure 1:
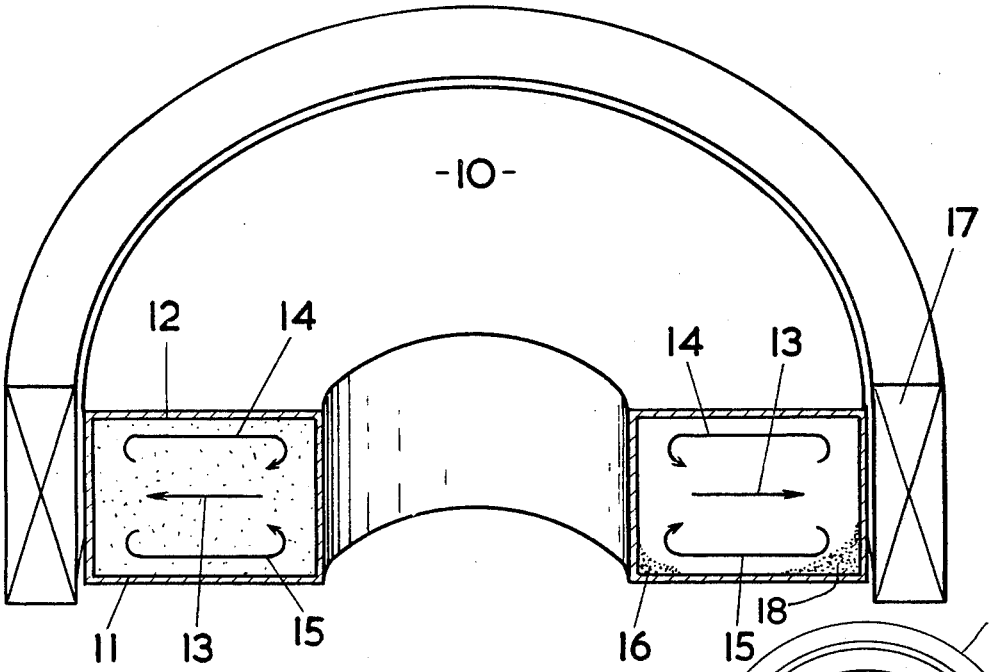
FIG. 1 is a partly sectioned view of an arcuate channel separation zone.

Referring initially to FIG. 1, this shows an arcuate channel separation zone in the form of a square cross-section fluid duct 10 extending through greater than 180°. The duct 10 is shown sectioned along the 180° plane. Shown in the left-hand section of the duct 10 is the pattern of liquid flow which takes place transversely to the duct at the same time that the liquid flows around the duct.

Without prejudice to the present invention, it is believed that when a flowing stream of liquid is directed in a curved path by an arcuate channel, the centrifugal force acting on the liquid tends to force it radially outwardly, which force is less because of the friction resistance of the radial floor of the channel. Accordingly, the greatest radial outward flow of the liquid takes place at some point elevated from the floor of the channel and there is a return flow radically inwardly over that floor. Fine particles travelling with the liquid are to a greater or lesser extent affected by the drag exerted thereon. Therefore, such particles will be swirled with the liquid and provided that they have a specific gravity greater than 1, will be carried radially inwardly across the floor of the channel and will largely collect at the lower radially inward corner of the channel and travel along the channel at such a location. This is in fact opposite to the position that would be expected which would be that the particles would congregate in the lower radially outward corner of the channel.

Thus the centrifugal force which acts on the liquid by the constraint placed upon it by the duct 10 to pass around a curved path is resisted by the frictional forces exerted by the floor and ceiling 11 and 12 of the duct. The greatest radially outward flow, therefore, occurs at approximately the mid-plane of the duct 10, ie midway between the floor and ceiling 11, 12 as indicated by the arrow 13. The flow shown by the arrow 13 is compensated by a swirling flow of liquid upwardly and downwardly, so providing a return flow of the liquid along the arrows marked 14 and 15. It is found in practice that this liquid flow transverse to the duct is developed very quickly after the liquid enters the curved path of the duct 10.

Considering the case when particles are carried along in the liquid flow, the particles having a density greater than that of the liquid, ie in the case of the liquid being water a specific gravity of greater than 1, the following emerges. The particles will naturally flow towards the floor 11 of the duct 10 and they will therefore be affected to a greater degree by the liquid flow indicated by the arrow 15. Particles will therefore tend to collect in the lower radially inward corner of the duct as shown at 16. This has been proved experimentally.

In this example, the duct 10 is positioned within an annular magnet shown schematically at 17 which attracts the particles radially outwardly in proportion to their magnetic susceptibility. Therefore the particles having the greatest magnetic susceptibility are able to resist the radially inward flow of the liquid shown by the arrow 15, and are able to collect in the lower radially outward corner of the duct 10 as shown at 18. The settlement of the particles in their respective corners does not take place immediately and, therefore, 16 and 18 are indicated in the righthand section of the drawing of FIG. 1 only. The left hand side represents the inlet to the channel, the right hand side the outlet end.

Of particular benefit is the fact that the swirling action of the liquid which develops before the particles settle in their stable paths of travel along the channel sweeps the particles to a greater or lesser degree close to the magnet and therefore to the higher magnetic field and magnetic field gradient. Accordingly, even weakly susceptible particles can be held in a path of travel dictated by the attractive force of the magnet rather than having to be attracted across a liquid stream against the drag exerted on the particle.

It follows that preferably the swirling flow of the liquid should not be established in its final form before the liquid reaches the influence of the magnet because there would be a danger that all of the particles would congregate in the inner corners and would not be so easily separated by the magnet. Preferably, therefore, the inlet is not arcuate in the same sense as the separation zone, and preferably further it is tangential.

The separation zone has to be of a length and radius in relation to the velocity of the flow of the liquid that there can be established the swirling liquid flow and the separation of the particles. Practically the arcuate channel separation zone can rotate through several complete revolutions around the interior of an annular magnet although normally between one quarter and one whole revolution is sufficient.

It will be appreciated that the particles are still travelling along the duct 10 with the liquid, although more slowly as they are frictionally affected by the sides and floor of the channel. There is, therefore, a continuous opportunity for magnetically susceptible particles which have lodged amongst the less susceptible particles in the corner 16 to free themselves and move to the corner 18 and vice versa.

As outlined above, it is preferred that the inlet be tangential or it may be rectilinear or arcuate in the opposite sense in order that the particles shall preferably be randomly scattered within the liquid stream. As the swirling motion develops, caused by the centrifugal force, the particles are swept around into the close vicinity of the magnet 17 and therefore into the parts of the duct 10 having the higher magnetic field and magnetic field gradient. In this way, even the weakly susceptible particles which may be very fine and therefore greatly affected by liquid drag can be captured by the magnet and collected in the corner 18.

Figure 2:
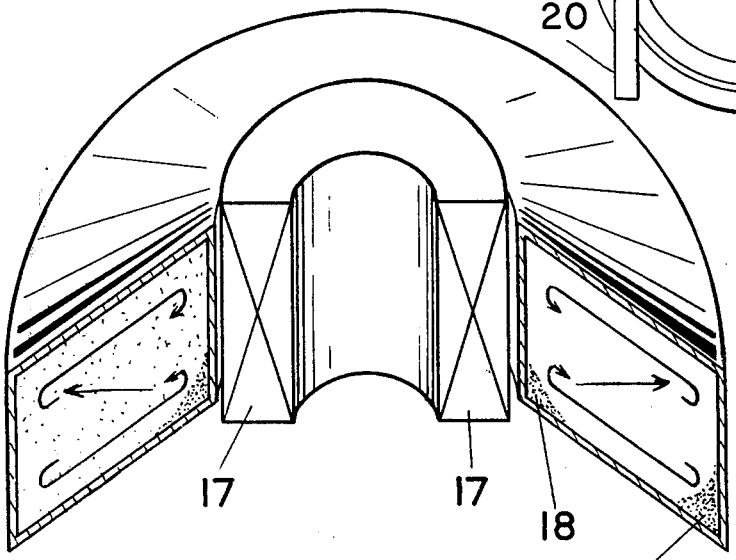
FIG. 2 is a view similar to that of FIG. 1 showing a modification thereof.

Referring now to FIG. 2 of the drawings, this shows a modification in which the duct 10 is a different shape in order that there shall be provided in the lower radially outward corner 16 a zone of slow moving liquid which can therefore deposit particles under the actions of gravity and centrifugal force. This is done by sloping the floor of the channel downwardly in the outward direction to counteract the inward force on the particles referred to with reference to FIG. 1. It can be seen that the cross-sectional shape of the channel is in the form of a parallelogram. The floor of the illustrated channel is therefore frustoconical in shape although the whole channel may be spirally arranged around a suitable magnet to increase the separation zone. The magnet 17 is provided internally of the duct and acts to provide an attractive force on the particles of greater susceptibility which, in addition to the radially inward flow of the liquid, is sufficient to hold these particles in the radially inward corner 18.

It will be appreciated that the explanations given above regarding liquid flow are independent of whether or not the top of the duct 10 is closed or open. In practice, it is preferred that it be closed in order that the whole system can be under hydrostatic pressure and in this event the frictional force provided by the ceiling 12 of the duct increases the swirling action of the liquid.

Various tests have been carried out using the duct as shaped in FIG. 1 and the results of these are given as follows.

1. A 50/50 mixture of hematite and quartz, ground to minus 75$\mu$m (micrometers), was passed through a channel of 1 inch side corresponding to FIG. 2, in a water suspension containing 30% solids by weight. The feed rate was 720 liters per hour. 85% of the hematite was transferred into the magnetic concentrate in a single pass. The concentrate contained less than 5% of quartz.

2. A mixture of 95% quartz and 5% hematite was similarly treated. The non-magnetic quartz product from the separation contained less than 0.5% of hematite and 95% of the quartz was recovered in a single pass.

3. A mixture of 70% chromite and 30% silicate gangue, ground to minus 150$\mu$m, was similarly treated. The magnetic concentrate obtained in a single pass contained less than 2% of silicate gangue and 92% of the chromite was recovered.

4. A mixture of chromite and silicate gangue in the same proportions as in Example 3 but ground to minus 45$\mu$m was similarly treated, at a reduced feed rate of 500 liters per hour. The magnetic concentrate obtained in a single pass contained less than 2.5% of silicate gangue and 75% of the chromite was recovered.

The duct 10 of FIG. 1 or FIG. 2 preferably terminates by being open to the atmosphere. The particles which have been travelling in the corners 16 or 18 spray from the duct, and can readily be captured in separate ducts positioned as required. In the case of the duct shape shown in FIG. 2, this is particularly easy to arrange insofar as the centrifugal force acting on the liquid and the particles in the corner 16 throws those particles and most of the water outwardly along a tangential path. The more magnetically susceptible particles 18 have their trajectory affected by the magnet whereby they are well divided from the other particles and they entrain little liquid. The particles can then be collected as a slurry with a solids content as high as 50%.

Figure 3:
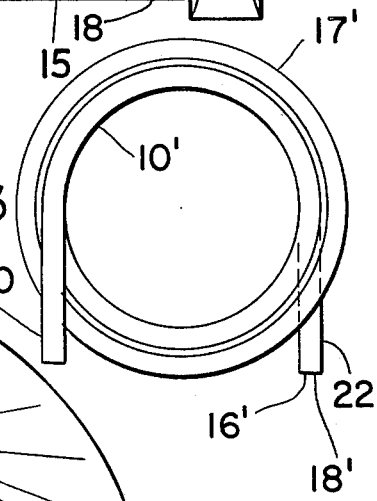
FIG. 3 is a plan view of a further embodiment.

FIG. 3 illustrates in plan view an embodiment which has some features in common with FIG. 1. In the FIG. 3 embodiment the duct 10' rotates through several complete revolutions within an annular magnet 17' and communicates at its ends with a tangential inlet 20 and a tangential outlet 22. The operation is the same as described with respect to FIG. 1, the particles of greatest magnetic susceptibility being discharged at 18' and the particles of lesser magnetic susceptibility being discharged at 16'.

The magnetic fields used particularly with reference to FIGS. 1 and 2 can be of the order of 0.5 to 20 kilogauss which is achievable using a conventional magnet, or up to 50–60 kilogauss or higher, in which case a superconducting magnet is essential. A magnetic field gradient of 10–20 kilogauss/cm or greater is preferred.

We claim:

1. A magnetic separator system for the separation of magnetically susceptible particles from a mixture of magnetically susceptible particles and non-magnetic or less magnetically susceptible particles comprising an inlet for feeding a flowing stream of fluid containing the mixture in fluidized condition, the inlet leading to an arcuate separation channel in which fluid flowing therethrough will be subjected to centrifugal force, said channel having an inlet end and an outlet end and spaced apart arcuate inner and outer walls and at least one connecting wall extending between the arcuate walls, said walls constraining the stream to flow in a single unidirectional arcuate path along the channel in frictional contact with the inner and outer walls and with the connecting wall, fixed magnet means adjacent one of the arcuate walls and extending along at least the major portion of the length and height thereof, said magnet means establishing a radial magnetic field gradient extending radially across the channel and over at least the major portion of the length thereof, so that the magnetic field gradient, centrifugal force and frictional resistance to flow acting on a fluid stream containing the mixture cooperate to cause the magnetically susceptible particles to gravitate toward the magnet while moving through the channel, first and second outlets leading from different radial sides of said length of channel whereby the magnetically susceptible particles are attracted into the outlet, which is adjacent the magnet and the non-magnetic or less magnetically susceptible particles pass into the outlet which is remote from the magnet.

2. A separator as in claim 1, wherein the channel is rectangular in radial cross section and wherein the connecting wall is substantially flat, the magnet being disposed adjacent the outer arcuate wall.

3. A separator as in claim 2, wherein the channel extends spirally through several complete revolutions.

4. A separator as in claim 2, wherein the channel is circumferentially closed by a further connecting wall.

5. A separator as in claim 1, wherein the inner and outer arcuate walls are arcuate with respect to a vertical axis, wherein the lower connecting wall is of truncated conical shape and wherein the magnet is disposed adjacent the inner arcuate wall.

6. A separator as in claim 5, wherein the channel is helical.

7. A separator as in claim 5, wherein the channel is circumferentially closed by a further connecting wall.

8. A separator as in claim 1, wherein the magnet is an electromagnet.

9. A separator as in claim 8, wherein the electromagnet is a superconductive magnet.

10. A method of separating magnetically susceptible particles from a mixture of magnetically susceptible particles and non-magnetic or less magnetically susceptible particles comprising the steps of introducing a stream containing the mixture in a fluidized condition under pressure or under gravity into one end of an arcuate separation channel having an inlet end and an outlet end and arcuate inner and outer walls and at least one connecting wall which constrain the stream to flow in a single undirectional arcuate path along the channel in frictional contact with the inner and outer walls and with the connecting wall, the velocity of the stream and the frictional resistance to flow being such that the stream is subject to sufficient centrifugal force as it flows around the channel that there is produced in the channel a secondary circulation radially outwardly within the body of the stream and then radially inwardly, subjecting the stream during its passage around the channel to a radial magnetic field gradient from a fixed magnet so that the magnetic force and the secondary circulation cooperate to cause the magnetically susceptible particles to gravitate toward the magnet while moving through the channel, removing the magnetically susceptible particles from that radial side of the arcuate channel which is adjacent the magnet and removing the non-magnetic or less magnetically susceptible particles from that radial side which is remote from the magnet.

11. A method as in claim 10, wherein the magnetic field is established by a magnet disposed adjacent the outer arcuate wall.

12. A method as in claim 10, wherein the magnetic field is established by a magnet disposed adjacent the inner arcuate wall.

* * * * *

UNITED STATES PATENT OFFICE

CERTIFICATE OF CORRECTION

Patent No. 4,017,385 Dated Apr. 12, 1977

Inventor(s) Peter Harlow Morton, Enrico Cohen and Jeremy Andrew Good

It is certified that error appears in the above-identified patent and that said Letters Patent are hereby corrected as shown below:

In heading "[30]" the date of the second priority is incorrect and should read -- July 17, 1974 --.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*